US010752869B2

(12) United States Patent
Tan et al.

(10) Patent No.: US 10,752,869 B2
(45) **Date of Patent: *Aug. 25, 2020**

(54) LAUNDRY DETERGENT SHEET COMPRISING LINES OF FRANGIBILITY

(71) Applicant: The Procter & Gamble Company, Cincinnati, OH (US)

(72) Inventors: Hong Sing Tan, Beijing (CN); MIng Tang, Beijing (CN); Mark Robert Sivik, Cincinnati, OH (US); Frank William Denome, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 188 days.

This patent is subject to a terminal disclaimer.

(21) Appl. No.: 15/888,122

(22) Filed: Feb. 5, 2018

(65) Prior Publication Data

US 2018/0223229 A1 Aug. 9, 2018

(30) Foreign Application Priority Data

Feb. 6, 2017 (CN) ..... 2017/072935

(51) Int. Cl.

| | |
|---|---|
| ***C11D 17/04*** | (2006.01) |
| ***C11D 11/00*** | (2006.01) |
| ***C11D 3/37*** | (2006.01) |
| ***C11D 3/22*** | (2006.01) |
| ***C11D 1/37*** | (2006.01) |
| *C11D 1/14* | (2006.01) |
| *C11D 1/22* | (2006.01) |
| *C11D 1/29* | (2006.01) |

(52) U.S. Cl.

CPC ..... *C11D 17/044* (2013.01); *C11D 1/37* (2013.01); *C11D 3/222* (2013.01); *C11D 3/3707* (2013.01); *C11D 3/3753* (2013.01); *C11D 11/0017* (2013.01); *C11D 1/146* (2013.01); *C11D 1/22* (2013.01); *C11D 1/29* (2013.01)

(58) Field of Classification Search

CPC ..... C11D 7/044
USPC ..... 428/43
See application file for complete search history.

(56) References Cited

U.S. PATENT DOCUMENTS

| | | | |
|---|---|---|---|
| 5,677,296 | A | 10/1997 | Chrusciel et al. |
| 5,818,606 | A | 10/1998 | Muramatsu et al. |
| 7,094,744 | B1 | 8/2006 | Kobayashi |
| 7,659,239 | B2 | 2/2010 | King |
| 9,179,814 | B2 | 11/2015 | Tekulve et al. |
| 9,827,173 | B2 | 11/2017 | Lynch et al. |

(Continued)

FOREIGN PATENT DOCUMENTS

| | | |
|---|---|---|
| CN | 105199887 | 12/2015 |
| CN | 205398584 | 7/2016 |

(Continued)

OTHER PUBLICATIONS

PCT Search Report for application No. PCT/CN2017/072926, dated Oct. 17, 2017, 5 pages.

(Continued)

*Primary Examiner* — Brent T O'Hern
(74) *Attorney, Agent, or Firm* — Andres E. Velarde

(57) ABSTRACT

A non-fibrous laundry detergent sheet includes at least one line of frangibility for separating the sheet into smaller sections with different sizes.

15 Claims, 4 Drawing Sheets

(56) References Cited

U.S. PATENT DOCUMENTS

| | | | | |
|---|---|---|---|---|
| 2002/0013251 | A1* | 1/2002 | Hayashi | C11D 1/62 510/445 |
| 2010/0294153 | A1 | 11/2010 | Content et al. | |
| 2011/0136719 | A1 | 6/2011 | Jalbert et al. | |
| 2012/0239622 | A1 | 9/2012 | Elron et al. | |
| 2012/0296603 | A1 | 11/2012 | Kulik et al. | |
| 2013/0269137 | A1 | 10/2013 | Tekulve et al. | |
| 2014/0024103 | A1 | 1/2014 | Benie et al. | |
| 2015/0159330 | A1 | 6/2015 | Weisman et al. | |
| 2015/0218497 | A1 | 8/2015 | Jalbert et al. | |
| 2016/0362641 | A1 | 12/2016 | Souter et al. | |
| 2017/0234618 | A1 | 8/2017 | Guo | |
| 2018/0223230 | A1* | 8/2018 | Tan | C11D 17/044 |

FOREIGN PATENT DOCUMENTS

| | | |
|---|---|---|
| DE | 19955240 | 5/2001 |
| KR | 20120130693 | 12/2012 |
| WO | WO2009047124 | 4/2009 |
| WO | WO2012158751 A1 | 11/2012 |

OTHER PUBLICATIONS

PCT Search Report for application No. PCT/CN2017/072927, dated Nov. 10, 2017, 6 pages.
PCT Search Report for application No. PCT/CN2017/072935, dated Feb. 15, 2017, 4 pages.
U.S. Appl. No. 15/888,114, filed Feb. 5, 2018, Hong Sing Tan.
U.S. Appl. No. 15/888,115, filed Feb. 5, 2018, Hong Sing Tan.

* cited by examiner

LAUNDRY DETERGENT SHEET COMPRISING LINES OF FRANGIBILITY

FIELD OF THE INVENTION

The invention relates to a non-fibrous laundry detergent sheet comprising one or more lines of frangibility while the lines of frangibility form two or more sections with different sizes.

BACKGROUND OF THE INVENTION

Laundry detergent sheet is a new type of form for laundry detergent product. Commercially marketed laundry sheet may be configured to employ lines of frangibility such that a user of laundry sheet can tear the sheet into two or more portions for immediate and/or later use. However, commercially marketed laundry sheet suffers from at least one drawback. When doing laundry, the consumer may need different doses of detergent for different purposes. For example, she may use a larger dose for machine-washing a heavy load of garments and fabrics and a smaller dose for hand-washing just a few pieces of clothing, and she may use different amounts of smaller doses for pretreating different stains on clothes. The commercially marketed laundry sheet, however, can merely be divided into strips of the same size of e.g. 5 cm*10 cm. These same-size strips of laundry sheet do not allow the consumer to easily get different detergent doses. For example, consumers who need to use only a smaller dose (smaller than the 5 cm*10 cm strip) for pretreating a stain are forced to either use an unnecessarily large dose or tear the strip into an undesirably irregular shape. Accordingly, there is a need to provide a laundry detergent sheet which can be easily separated into pieces with different sizes for differential dosing.

SUMMARY OF THE INVENTION

The laundry detergent sheet having one or more lines of frangibility which separate the sheet into sections of different sizes and/or shapes so that the consumer may select a section that is best suited for a particular purpose (pretreating or hand-washing with smaller detergent dosage).

The present invention provides a non-fibrous laundry detergent sheet, comprising at least one surfactant and at least one film former, while the laundry detergent sheet is completely or substantially water-soluble. Preferably, the laundry detergent sheet has a thickness ranging from 0.1 mm to 10 mm, a length to thickness aspect ratio of at least 5:1, and a width-to-thickness aspect ratio of at least 5:1. Preferably, the laundry detergent sheet comprises at least a first section and a second section separated by at least one line of frangibility, while the first section and the second section have different sizes.

Preferably, the non-fibrous laundry detergent sheet further comprises a third section separated from the first and second sections by addition line(s) of frangibility, while the third section has the same or different size from the first section or the second section.

Preferably, the first and second sections of the laundry detergent sheet are marked by different size indicators, different artworks, or different colors, while the different size indicators designate different laundry detergent doses.

Preferably, the line(s) of frangibility are formed by indentation or perforation.

Preferably, the non-fibrous laundry detergent sheet of the present invention is elongated with a longitudinal direction and is wound into a roll along said longitudinal direction.

These and other aspects of the present invention will become more apparent upon reading the following detailed description of the invention.

BRIEF DESCRIPTION OF THE DRAWINGS

The embodiments set forth in the drawings are illustrative in nature and not intended to limit the invention defined by the claims. The following detailed description of the illustrative embodiments can be understood when read in conjunction with the following drawings, and in which:

DETAILED DESCRIPTION OF THE INVENTION

Figure 1:
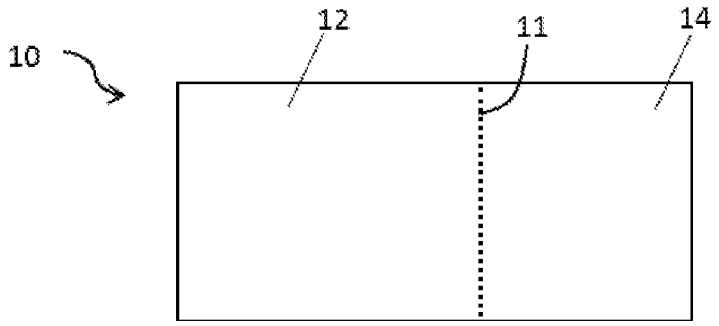
FIG. 1 shows an exemplary laundry detergent sheet comprising two sections with different sizes, according to a specific embodiment of the present invention.

Features and benefits of the various embodiments of the present invention will become apparent from the following description, which includes examples of specific embodiments intended to give a broad representation of the invention. Various modifications will be apparent to those skilled in the art from this description and from practice of the invention. The scope of the present invention is not intended to be limited to the particular forms disclosed and the invention covers all modifications, equivalents, and alternatives falling within the spirit and scope of the invention as defined by the claims.

As used herein, the articles including "the", "a" and "an" when used in a claim or in the specification, are understood to mean one or more of what is claimed or described. As used herein, the terms "comprise", "comprising", "include", "including", "contain", and "containing" are meant to be non-limiting, i.e., other steps and other ingredients which do not affect the end of result can be added. In this description, all concentrations and ratios are on a weight basis unless otherwise specified. As used herein, the term "plurality" means more than one.

As used herein, the term "water-soluble" refers to a solubility of more than about 30 grams per liter (g/L) of deionized water measured at 20° C. and under the atmospheric pressure. The term "substantially water-soluble" refers to a solubility of more than about 25 grams per liter (g/L) of deionized water measured at 20° C. and under the atmospheric pressure.

As used herein, the term "sheet" refers to a three-dimensional shape having a thickness, a length, and a width, while the length-to-thickness aspect ratio and the width-to-thickness aspect ratio are both at least about 5:1, and the length-to-width aspect ratio is at least about 1:1. Preferably, the length-to-thickness aspect ratio and the width-to-thickness aspect ratio are both at least about 10:1, and the length-to-width aspect ratio is at least about 1.2:1. More preferably, the length-to-thickness aspect ratio and the width-to-thickness aspect ratio are both at least about 15:1, and the length-to-width aspect ratio is at least about 1.5:1. Most preferably, the length-to-thickness aspect ratio and the width-to-thickness aspect ratio are both at least about 20:1, and the length-to-width aspect ratio is at least about 1.618:1.

As used herein, the term "non-fibrous" refers to a structure that is free of or substantially free of fibrous elements. "Fibrous element" as used herein means elongated particulate having a length greatly exceeding its average diameter, i.e., a length-to-average-diameter aspect ratio of at least 10:1, and an average diameter of no more than 1 mm.

As used herein, the term "laundry detergent" refers to all-purpose or "heavy-duty" washing agents, especially cleaning detergents, for fabrics, as well as cleaning auxiliaries such as bleach, rinse aids, additives, or pre-treat types.

As used herein, the term "Water Dissolvability" refers to the ability of a sample material to dissolve in water within a specific time period at 20° C. and under the atmospheric pressure without any stirring. This parameter is measured by placing 10 grams of the sample material in 1 liter of deionized water at 20° C. and under the atmospheric pressure for one (1) minute without any stirring. The remaining undissolved solids then are filtered out from the solution and immediately weighed (without drying). The Water Dissolvability is calculated as $$\frac{\text{Weight of Undissolved Solids}}{\text{10 grams}} \times 100\%.$$

As used herein, the terms "consisting essentially of" means that the composition contains no ingredient that will interfere with benefits or functions of those ingredients that are explicitly disclosed. Further, the terms "essentially free of," "substantially free of" or "substantially free from" means that the indicated material is present in the amount of from 0 wt % to about 1 wt %, or preferably from 0 wt % to about 0.5 wt %, or more preferably from 0 wt % to about 0.1 wt %, and most preferably it is not present at analytically detectable levels. The term "substantially pure" or "essentially pure" means that the indicated material is present in the amount of from about 99.5 wt % to about 100 wt %, preferably from about 99.9 wt % to about 100 wt %, and more preferably from 99.99 wt % to about 100 wt %, and most preferably all other materials are present only as impurities below analytically detectable levels.

As used herein, all concentrations and ratios are on a weight basis unless otherwise specified. All temperatures herein are in degrees Celsius (° C.) unless otherwise indicated. All conditions herein are at 20° C. and under the atmospheric pressure, unless otherwise specifically stated. All polymer molecular weights are determined by weight average number molecular weight unless otherwise specifically noted.

The laundry detergent sheet of the present invention is non-fibrous, i.e., it is free of or substantially free of fibrous elements. Such a laundry detergent sheet can be formed by first providing a slurry containing raw materials dissolved or dispersed in water, and then shaping the slurry into a sheet-like form. Drying is carried out either simultaneously with the shaping step, or it can be carried out subsequently, to remove water and form a finished sheet with little or no moisture content (e.g., less than 3 wt % water).

The laundry detergent sheet of the present invention is completely or substantially water-soluble. In other words, it does not contain a water-insoluble substrate, as some of the conventional laundry detergent sheets do. The laundry detergent sheet of the present invention has a Water Dissolvability of at least 90%, preferably at least 95%, and more preferably at least 98%, and most preferably at least 99%, as measured according to the test method specified hereinafter. Preferably, the entire laundry detergent sheet of the present invention can be completely dissolved in a liter of deionized water, i.e., leaving no visible residue in the solution, within 15 seconds, more preferably within 10 seconds, and more preferably within 5 seconds, at 20° C. under atmospheric pressure and without any stirring.

The laundry detergent sheet of the present invention can have any shape or size, as long as its thickness, its length, and its width are characterized by a length-to-thickness aspect ratio of at least about 5:1, a width-to-thickness aspect ratio of at least about 5:1, and a length-to-width aspect ratio of at least about 1:1. Preferably, the length-to-thickness aspect ratio and the width-to-thickness aspect ratio are both at least about 10:1, and the length-to-width aspect ratio is at least about 1.2:1. More preferably, the length-to-thickness aspect ratio and the width-to-thickness aspect ratio are both at least about 15:1, and the length-to-width aspect ratio is at least about 1.5:1. Most preferably, the length-to-thickness aspect ratio and the width-to-thickness aspect ratio are both at least about 20:1, and the length-to-width aspect ratio is at least about 1.618:1. The thickness of the laundry detergent sheet of the present invention may range from about 0.1 mm to about 10 mm, preferably from about 0.2 mm to about 5 mm, more preferably from about 0.3 mm to about 4 mm, and most preferably from about 0.5 mm to about 2 mm. The width of the laundry detergent sheet may range from about 2 cm to about 1 meter, preferably from about 5 cm to about 50 cm, more preferably from about 10 cm to about 40 cm. The length of the laundry detergent sheet may range from about 2 cm to about 50 meters, preferably from about 5 cm to about 1 meter, and more preferably from about 10 cm to about 80 cm.

In a preferred but not necessary embodiment of the present invention, the laundry detergent sheet has a golden rectangular shape (i.e., with a length-to-width aspect ratio of about 1.618:1), and it is characterized by a width of about 10 to about 15 cm and a thickness of about 0.5 mm to about 2 mm Such a golden rectangular shape is aesthetically pleasing and delightful to the consumers, so multiple sheets of such shape can be stacked up and packaged together for sale in a container that is also characterized by a similar golden rectangular shape.

In an alternative embodiment of the present invention, the laundry detergent sheet has an elongated shape (i.e., with a length-to-width aspect ratio of about 10-50:1), and it is characterized by a width of about 10 to 15 cm and a thickness of about 0.5 mm to about 2 mm Such elongated shape allows the laundry detergent sheet to be rolled up or folded into a compact unit for easy of packaging, storage, shipment and display.

The laundry detergent sheet of the present invention is characterized by a sufficiently high Surfactant Activity, e.g., at least 30%, preferably at least 50%, more preferably at least 60%, and most preferably at least 70%. Such high Surfactant Activity provides a very compact and concentrated form of laundry detergent, which is particularly convenient for consumers who travel often and need to do laundry on the road. Further, shipping and handling costs for such compact and concentrated form are significantly reduced, in comparison with the traditional powder or liquid forms of laundry detergents, which make this laundry detergent sheet particularly desirable to be marketed through e-commerce channels.

Preferably, the laundry detergent sheet of the present invention has certain attributes that render it aesthetically pleasing to the consumers. For example, the sheet may have a relatively smooth surface, thereby providing a pleasant feel when touched by the consumer. Further, it is desirable that the laundry detergent sheet may have little or no perceivable pores on its surface.

It is also desirable that the laundry detergent sheet of the present invention is strong to withstand substantive mechanical forces without losing its structural integrity, yet at the same time is sufficiently flexible for ease of packaging and storage.

Lines of Fragibility

The present invention provides a non-fibrous laundry detergent sheet comprising lines of frangibility that separate the sheet into individual sections with different sizes. The advantage is that the sheet sections can be easily torn along the lines of frangibility into smaller pieces with different sizes desirable for different uses.

For example, the laundry detergent sheet of the present invention may contain at least a first section and a second section separated by at least one line of frangibility, while the first section and the second section have different sizes.

The laundry detergent sheet may have a generally rectangular shape. Alternatively, a laundry detergent sheet of the present invention may possess a variety of other shapes, including, for example, a generally square shape, a generally oval shape, or any other symmetrical shapes.

Preferably, the laundry detergent sheet has a length from 10 cm to 30 cm, preferably from 11 cm to 25 cm, more preferably from 12 cm to 20 cm; has a width from 5 cm to 18 cm, preferably from 6 cm to 15 cm, and more preferably from 7 cm to 13 cm, or from 10.5 cm to 12.5 cm; and has a thickness from 0.6 mm to 3 mm, preferably from 0.8 mm to 2 mm Herein the length refers to the longest dimension of the sheet section, and the width refers to the longest dimension perpendicular to the length on the plane of the sheet.

The separated, smaller sections defined by lines of frangibility may have desired dimensions in accordance with user's need. Preferably, such sections may have a length from 1 cm to 10 cm, preferably from 1.5 cm to 8 cm, more preferably from 2 cm to 6 cm; and a width from 1 cm to 10 cm, preferably from 1.5 cm to 8 cm, more preferably from 2 cm to 6 cm.

FIG. 1 is an example of the laundry detergent sheet of the present invention, comprising two sections with different sizes. Specifically, the laundry detergent sheet 10 comprises a first section 12 and a second section 14 separated by one line of frangibility 11, while the first section 12 and the second section 14 are rectangular in shape but are characterized by different sizes.

Preferably, the size ratio of the first section 12 to the second section 14 can be from above 1:1 to 10:1, preferably from 1.1:1 to 8:1, more preferably from 1.2:1 to 5:1, alternatively 1.5:1, or 1.618:1, or 2:1, or 2.5:1, or 3:1, or 3.5:1, or 4:1 etc.

The lines of frangibility may be introduced to the laundry detergent sheet by a variety of ways, e.g., indentation or perforation. In some embodiments, the lines of frangibility are composed of holes. In a preferred embodiment, the holes are circular in shape and have a diameter of about 1 mm or less; of about 0.8 mm or less; but of about 0.2 mm or greater, or of about 0.3 mm or greater. If the holes are of other shapes (e.g., square, triangular, etc.), then the dimension of such holes may correspond to the diameter described hereinabove for the circular holes. Lines of frangibility may comprise other embodiments, so long as they provide, in effect, lines of weakness along which a user may readily separate the detergent sheet into smaller sections.

Preferably, the laundry detergent sheet may further comprise a third section which is separated from the first and second sections by addition line(s) of frangibility. The third section may have a different size from both the first section and the second section. Alternatively, the third section may have the same size as either the first section or the second section.

Figure 2:
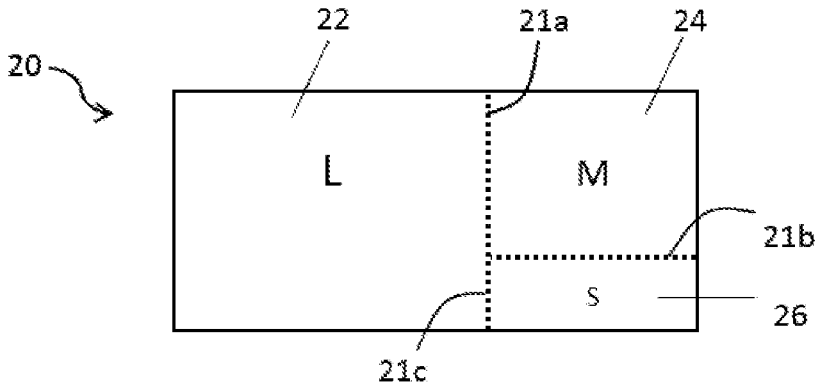
FIG. 2 shows an exemplary laundry detergent sheet comprising three sections with three different sizes marked by different size indicators, according to a specific embodiment of the present invention.

FIG. 2 shows an example of the laundry detergent sheet of the present invention, comprising three sections with three different sizes. Specifically, the laundry detergent sheet 20 comprises a first section 22, a second section 24 and a third section 26, which are separated by three lines of frangibility 21*a*, 21*b*, and 21*c*. The three sections 22, 24, 26 all have rectangular shapes but are characterized by different sizes.

Preferably, different sections in the laundry detergent sheet of the present invention are marked by different size indicators, which designate different laundry detergent doses. For example, the largest section 22 of the laundry detergent sheet 20 in FIG. 2 is marked by a size indicator "L" that stands for "large"; the intermediate section 24 is marked by a size indicator "M" that stands for "medium"; and the smallest section 26 is marked by a size indicator "S" that stands for "small". The different size indicators "L", "M", and "S" may be ink-printed onto the laundry detergent sheet 20, or they may be composed of lines of frangibility as well.

Preferably, the laundry detergent sheet further contains a fourth section, a fifth section, a sixth section, etc., which are separated from adjacent sections by lines of frangibility and which may have the same or different sizes from those previously mentioned sections. In a specific embodiment, the laundry detergent sheet contains fourth or more sections all having different sizes. In another alternative embodiment, the laundry detergent sheet contains four or more sections, some of which share a first size, while others share a second size, etc.

Figure 3:
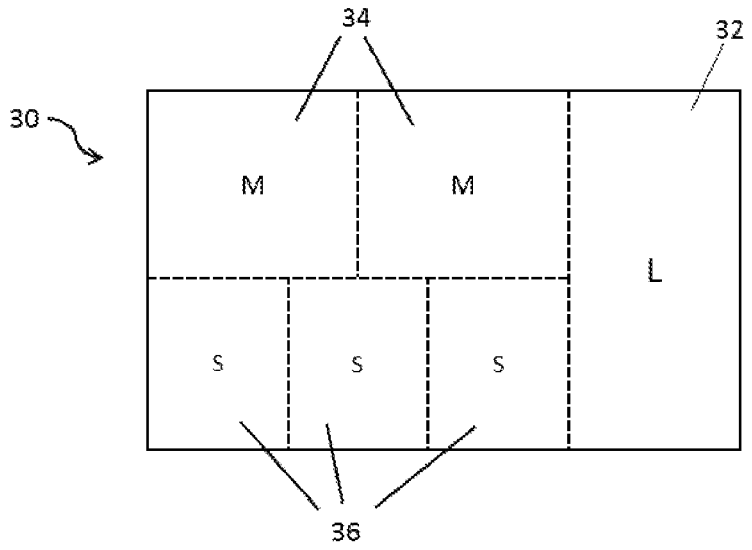
FIG. 3 shows an exemplary laundry detergent sheet comprising six sections with three different sizes marked by different size indicators, according to a specific embodiment of the present invention.

FIG. 3 is an example of the laundry detergent sheet of the present invention comprising six sections with three different sizes, marked by different size indicators. In FIG. 3, the laundry detergent sheet 30 comprises a large section 32 with a size indicator "L" marked thereon, two medium sections 34 of the same size, each with a size indicator "M" marked thereon, and three small sections 36 of the same size, each with a size indicator "S" marked thereon. As shown in FIG. 3, at least one line of frangibility has a first end and a second end and the at least one line of frangibility contacts the perimeter on at least one of the first end or the second end of the line of frangibility.

In other embodiments, different sections of the laundry detergent sheet can be marked by different colors, symbols, characters, messages, statements or artworks. Such colors, symbols, characters, messages, statements or artworks may be fashioned to help facilitate or establish an association between respective sections of the laundry detergent sheet and one or more detersive functions or benefits of such sections in the mind of a user. Further, such colors, symbols, characters, messages, statements or artworks may associate the laundry detergent sheet with the brand name of Tide®, Ariel®, and combinations thereof. Still further, such colors, symbols, characters, messages, statements or artworks may simply bring aesthetic delight to the consumer. Any method commonly known in the art, e.g., printing, stamping, gluing, embossing, or the like, may be used for marking the laundry detergent sheets, so long as the method does not interfere with the integrity of the laundry detergent sheet.

In an alternative embodiment, different sections of the laundry detergent sheet of the present invention may contain different active ingredients (e.g., different surfactants and/or different adjunct detergent ingredients). For example, a first section of the laundry detergent sheet may comprise a surfactant and a fabric hueing dye, while a second section thereof may comprise another surfactant and a perfume ingredient.

Figure 4:
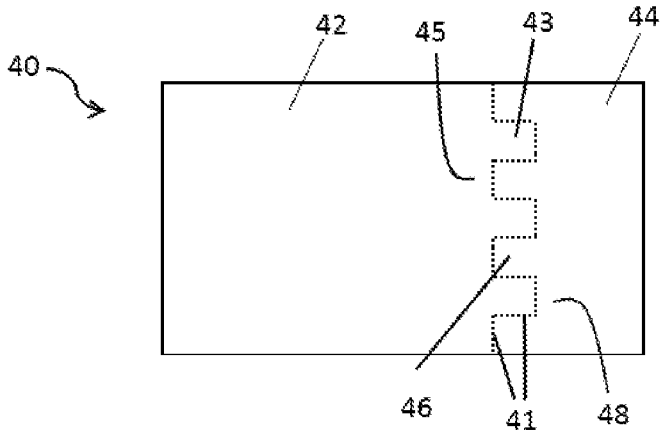
FIG. 4 shows an exemplary laundry detergent sheet comprising two sections having respective protrusions and intrusions for fitting together like a jig-saw puzzle, according to a specific embodiment of the present invention.

In other embodiments, the laundry detergent sheet can comprise a first section and a second section, while each of the sections has a periphery partially or completely defined by one or more lines of frangibility. The periphery of the first section comprises at least one protrusion, and the periphery of the second section comprises at least one intrusion, such that the protrusion of the periphery of the first section and the intrusion of the periphery of the second section can be fitted together to form the laundry detergent sheet like a jigsaw puzzle. Preferably, the periphery of the first section further comprises one or more additional intrusions, and the periphery of the second section further comprises one or more additional protrusions, while the additional intrusions and protrusions are fitted together like a jigsaw puzzle. FIG. 4 shows an example of a laundry detergent sheet 40 containing a first section 42 and a second section 44 separated by multiple lines of frangibility 41, while the multiple lines of frangibility 41 define for the first section 42 a periphery comprising multiple protrusions 43 and multiple intrusions 45 and for the second section 44 a periphery comprising multiple protrusions 46 and intrusions 48. The respective protrusions 43 and 46 and intrusions 48 and 45 of the first and second sections 42 and 44 are fitted together to form the laundry detergent sheet 40.

Figure 5:
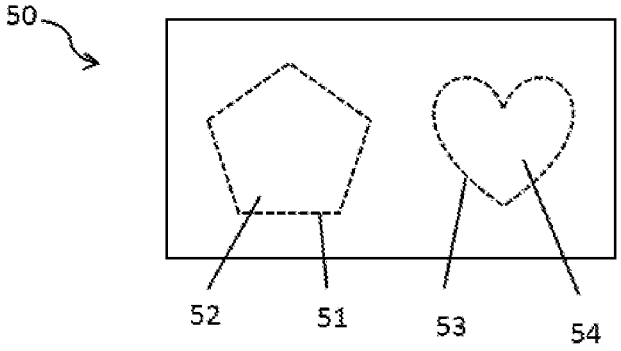
FIG. 5 shows an exemplary laundry detergent sheet comprising two sections with different shapes, according to a specific embodiment of the present invention.

In some embodiments, the laundry detergent sheet may comprise at least a first section and a second section which are spaced apart and isolated from each other, while each of the first and second section is completely delineated by one or more lines of frangibility. Preferably, the first and second sections have different shapes; and more preferably, they both have symmetrical shapes. FIG. 5 exemplifies such a laundry detergent sheet 50 containing a first section 52 of a heart shape, and a second section 54 of a pentagonal shape. The first section 52 and second section 54 are spaced apart and isolated from each other, while they are completely delineated by respective lines of frangibility 51 and 53. In other examples, the one or more lines of frangibility delineating the first and second sections constitute specific design (e.g. a pattern or a logo).

In other embodiments, the laundry detergent sheet may include a plurality of sections of complex geometric shapes, while each of the sections has a periphery that is partially or completely defined by one or more lines of frangibility, and such periphery includes at least one protrusion and at least one intrusion, so that the protrusions and intrusions from adjacent sections can be fitted together like a jigsaw puzzle to form the laundry detergent sheet. Preferably, all of the sections have the same shape, e.g., Gosper islands. Alternatively, the plurality of sections may have different shapes.

Figure 6:
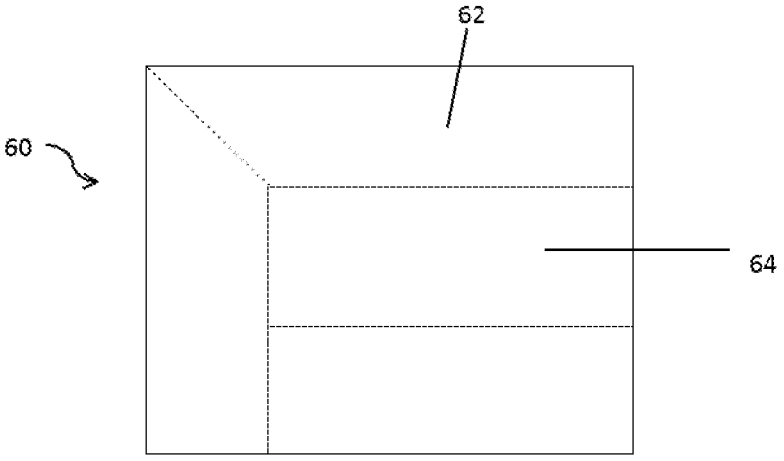
FIG. 6 shows an exemplary laundry detergent sheet comprising four sections with two different shapes which is fitted for collar and cuff respectively, according to a specific embodiment of the present invention.

In a specific embodiment of the present invention, the laundry detergent sheet may include sections having different shapes which are adapted for pre-treating particular areas of clothing e.g., the collar or cuff of a shirt. FIG. 6 shows an example of a laundry detergent sheet of the present invention comprising four sections of two different sizes, having shapes adapted for pre-treating shirt collar and cuffs, respectively. Specifically, the laundry detergent sheet 60 comprises two (2) first sections 62 each with a shape and/or size matching half of a shirt collar, and two (2) second sections 64 each of which has a shape and/or size matching a shirt cuff. In this case, one piece of the laundry detergent sheet of the present invention can be suitably used to pre-treat one shirt. The numbers of the different sections can be varied depending on the need. For example, the laundry detergent sheet may alternatively include twelve (12) sections with two (2) different shapes, e.g., including four (4) first sections each having a shape fitted for a shirt collar, and eight (8) second sections each having a shape fitted for a shirt cuff. Accordingly, such a sheet is suitable for pre-treating four shirts. The advantage is that the consumer can easily tear a section from such sheet for pre-treating heavily-stained areas (collar or cuff) of clothing with an exact fit shape-wise.

Figure 7A:
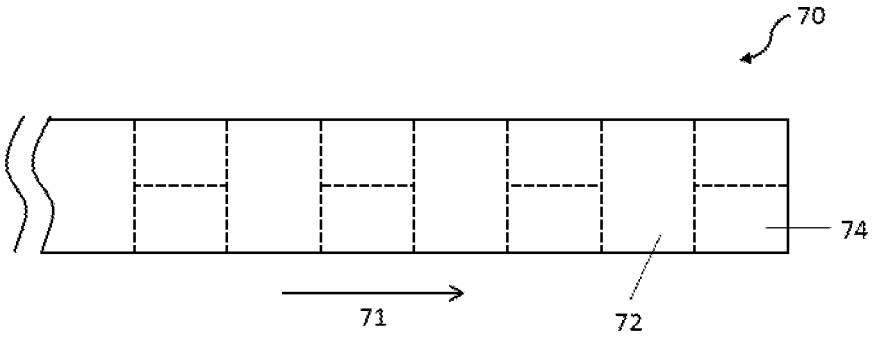
FIGS. 7A and 7B show an elongated laundry detergent sheet that can be wound into a roll along its longitudinal direction, according to a specific embodiment of the present invention.
Figure 7B:
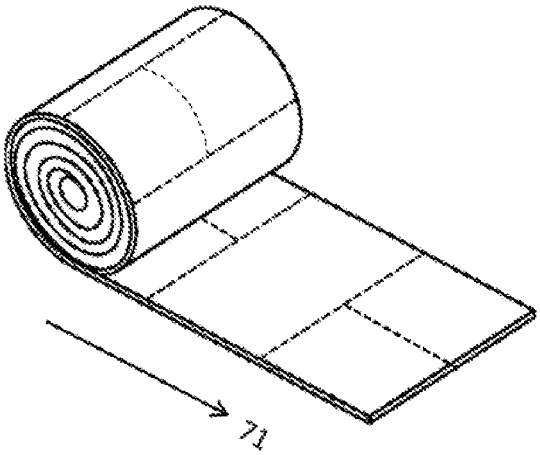

In other embodiments, the laundry detergent sheet can be elongated and is wound into a roll along a longitudinal direction. FIG. 7A exemplifies an elongated laundry detergent sheet 70 that extends along a longitudinal direction 71 and contains a plurality of larger sections 72 and a plurality of smaller sections 74. FIG. 7B shows the elongated laundry detergent sheet 70 of FIG. 7A being wound into a roll along the longitudinal direction 71. The advantage of such elongated design for the detergent sheet is that it can be rolled up like a toilet paper roll or a kitchen paper roll, for easy storage, and also the consumer can easily tear off a larger or smaller piece along lines of frangibility as needed based on the wash load.

Another aspect of the present invention provides a non-fibrous laundry detergent sheet, comprising at least one surfactant and at least one film former, while the laundry detergent sheet is completely or substantially water-soluble, and has a thickness ranging from 0.1 mm to 10 mm preferably, the laundry detergent sheet is elongated with a longitudinal direction and is wound into a roll along said longitudinal direction; while the laundry detergent sheet comprises at least one line of frangibility so that the laundry detergent sheet can be separated into two or more sub-sheets by the line of frangibility. For example, the at least line of frangibility can be perpendicular to the longitudinal direction. The lines of frangibility can be configured to separate the laundry detergent sheet into sub-sheets with any desired shape, such as rectangular shape, diamond shape, triangular shape, trapezoid shape, etc. Preferably the sub-sheet has a rectangular shape. The lines of frangibility can also be configured to separate the laundry detergent sheet into sub-sheets with any desired size for different loading requirement.

Surfactants

The non-fibrous laundry detergent sheet of the present invention may comprise at least one surfactant selected from the group consisting of anionic surfactants, nonionic surfactants, amphoteric surfactants, cationic surfactants, and combinations thereof. Such at least one surfactant form a surfactant system in the non-fibrous laundry detergent sheet, which can be present in an amount ranging from about 5% to about 90%, preferably from about 10% to about 90%, more preferably from about 20% to about 90%, still more preferably from about 30% to about 90%, and most preferably from about 50% to about 90%, by total weight of the non-fibrous laundry detergent sheet.

In a particularly preferred but not necessary embodiment of the present invention, the laundry detergent sheet may have a surfactant system containing only anionic surfactants, e.g., either a single anionic surfactant or a combination of two or more different anionic surfactants. Alternatively, the laundry detergent sheet of the present invention may have a composite surfactant system, e.g., containing a combination of one or more anionic surfactants with one or more nonionic surfactants, or a combination of one or more anionic surfactants with one or more amphoteric surfactants, or a combination of one or more anionic surfactants with one or more cationic surfactants, or a combination of all the above-mentioned types of surfactants (i.e., anionic, nonionic, amphoteric and cationic). Preferably but not necessarily, the laundry detergent sheet of the present invention has a composite surfactant system containing a combination of one or more anionic surfactants with one or more nonionic surfactants.

Anionic Surfactants

Anionic surfactants suitable for forming the laundry detergent sheet of the present invention can be readily selected from the group consisting of $C_6$-$C_{20}$ linear or branched alkyl benzene sulfonates (LAS), $C_6$-$C_{20}$ linear or branched alkyl sulfates (AS), $C_6$-$C_{20}$ linear or branched alkyl alkoxylated sulfates (AAS), $C_6$-$C_{20}$ linear or branched alkyl sulfonates, $C_6$-$C_{20}$ linear or branched alkyl carboxylates, $C_6$-$C_{20}$ linear or branched alkyl phosphates, $C_6$-$C_{20}$ linear or branched alkyl phosphonates, and combinations thereof. Preferred anionic surfactants of the present invention are selected from the group consisting of LAS, AS, AAS, and combinations thereof. The total amount of anionic surfactants in the laundry detergent sheet may range from 5% to 90%, preferably from 10% to 80%, more preferably from 20% to 75%, and most preferably from 30% to 70%, by total weight of the non-fibrous laundry detergent sheet.

Mid-Cut AS

A particularly preferred type of anionic surfactants for forming the non-fibrous laundry detergent sheet of the present invention are $C_6$-$C_{18}$ alkyl sulfates, which are referred to as "mid-cut AS" hereinafter, while each of which has a branched or linear unalkoxylated alkyl group containing from about 6 to about 18 carbon atoms. In a particularly preferred embodiment of the present invention, the mid-cut AS is present as the main surfactant in the laundry detergent sheet, i.e., it is present in an amount that is greater than 50% by total weight of all surfactants in said sheet, while other anionic surfactants (such as LAS and/or AAS) are present as co-surfactants for such mid-cut AS.

The mid-cut AS of the present invention has the generic formula of $R—O—SO_3^- M^+$, while R is branched or linear unalkoxylated $C_6$-$C_{18}$ alkyl group, and M is a cation of alkali metal, alkaline earth metal or ammonium. Preferably, the R group of the AS surfactant contains from about 8 to about 16 carbon atoms, more preferably from about 10 to about 14 carbon atoms, and most preferably from about 12 to about 14 carbon atoms. R can be substituted or unsubstituted, and is preferably unsubstituted. R is substantially free of any alkoxylation. M is preferably a cationic of sodium, potassium, or magnesium, and more preferably M is a sodium cation.

Such mid-cut AS surfactant(s) preferably functions as the main surfactant in the surfactant system of the non-fibrous laundry detergent sheet of the present invention. In other words, the mid-cut AS surfactant(s) are present in an amount of greater than 50% by total weight of all surfactants in the laundry detergent sheet.

Preferably, but not necessarily, the surfactant system of the present invention contains a mixture of mid-cut AS surfactants, in which $C_6$-$C_{14}$ AS surfactants are present in an amount ranging from about 85% to about 100% by total weight of the mixture. This mixture can be referred to as a "$C_6$-$C_{14}$-rich AS mixture." More preferably, such $C_6$-$C_{14}$-rich AS mixture contains from about 90 wt % to about 100 wt %, or from 92 wt % to about 98 wt %, or from about 94 wt % to about 96 wt %, or 100 wt % (i.e., pure), of $C_6$-$C_{14}$ AS.

In a particularly preferred embodiment of the present invention, the surfactant system contains a mixture of mid-cut AS surfactants comprising from about 30 wt % to about 100 wt % or from about 50 wt % to about 99 wt %, preferably from about 60 wt % to about 95 wt %, more preferably from about 65 wt % to about 90 wt %, and most preferably from about 70 wt % to about 80 wt % of $C_{12}$-$C_{14}$ AS, which can be referred to as a "$C_{12}$-$C_{14}$-rich AS mixture." Preferably, such $C_{12}$-$C_{14}$-rich AS mixture contains a majority of $C_{12}$ AS. In a most preferred embodiment of the present invention, the surfactant system contains a mixture of mid-cut AS surfactants that consist of $C_{12}$ and/or $C_{14}$ AS surfactants, e.g., 100% $C_{12}$ AS or from about 70 wt % to about 80 wt % of $C_{12}$ AS and from 20 wt % to about 30 wt % of $C_{14}$ AS, with little or no other AS surfactants therein.

A commercially available mid-cut AS mixture particularly suitable for practice of the present invention is Texapon® V95 G from Cognis (Monheim, Germany).

Further, the surfactant system of the present invention may contain a mixture of mid-cut AS surfactants comprising more than about 50 wt %, preferably more than about 60 wt %, more preferably more than 70 wt % or 80 wt %, and most preferably more than 90 wt % or even at 100 wt % (i.e., substantially pure), of linear AS surfactants having an even number of carbon atoms, including, for example, $C_6$, $C_8$, $C_{10}$, $C_{12}$, $C_{14}$, $C_{16}$, and $C_{18}$ AS surfactants.

The amount of mid-cut AS surfactants used in the present invention may range from about 5% to about 90%, preferably from about 10% to about 80%, more preferably from about 20% to about 75%, and most preferably from about 30% to about 70%, by total weight of the non-fibrous laundry detergent sheet. In a most preferred embodiment of the present invention, the non-fibrous laundry detergent sheet contains from about 10 wt % to about 60 wt %, preferably from about 20 wt % to about 50 wt %, of pure $C_{12}$ AS or a $C_{12}$-$C_{14}$-rich AS mixture by total weight of such sheet, while the $C_{12}$-$C_{14}$-rich AS mixture contains from about 70 wt % to about 80 wt % of $C_{12}$ AS and from 20 wt % to about 30 wt % of $C_{14}$ AS by total weight of such mixture.

LAS

The non-fibrous laundry detergent sheet of the present invention may contain, either alone as a main surfactant, or preferably in combination with the mid-cut AS described hereinabove as its co-surfactant, a $C_6$-$C_{20}$ linear alkylbenzene sulfonate (LAS). In a particularly preferred embodiment of the present invention, LAS is present as the main surfactant in the laundry detergent sheet, i.e., it is present in an amount that is greater than 50% by total weight of all surfactants in said sheet, while other anionic surfactants (such as mid-cut AS and/or AAS) are present as co-surfactants for such LAS.

LAS anionic surfactants are well known in the art and can be readily obtained by sulfonating commercially available linear alkylbenzenes. Exemplary $C_6$-$C_{20}$ linear alkylbenzene sulfonates that can be used in the present invention include alkali metal, alkaline earth metal or ammonium salts of $C_6$-$C_{20}$ linear alkylbenzene sulfonic acids, and preferably the sodium, potassium, magnesium and/or ammonium salts of $C_{11}$-$C_{18}$ or $C_{11}$-$C_{14}$ linear alkylbenzene sulfonic acids. More preferred are the sodium or potassium salts of $C_{12}$ linear alkylbenzene sulfonic acids, and most preferred is the sodium salt of $C_{12}$ linear alkylbenzene sulfonic acid, i.e., sodium dodecylbenzene sulfonate.

If present, the amount of LAS in the non-fibrous laundry detergent sheet of the present invention may range from about 5% to about 90%, preferably from about 10% to about 80%, more preferably from about 20% to about 75%, and most preferably from about 30% to about 70%, by total weight of the laundry detergent sheet. In a most preferred embodiment of the present invention, the non-fibrous laundry detergent sheet contains from about 5 wt % to about 20 wt % of a sodium, potassium, or magnesium salt of $C_{12}$ linear alkylbenzene sulfonic acid.

AAS

The non-fibrous laundry detergent sheet of the present invention may contain, either alone as a main surfactant, or preferably in combination with the mid-cut AS and/or LAS described hereinabove as a co-surfactant, a $C_{10}$-$C_{20}$ linear or branched alkylalkoxy sulfate (AAS) having an average degree of alkoxylation ranging from about 0.1 to about 5.

The AAS surfactants preferably are $C_{10}$-$C_{20}$ linear or branched alkylethoxy sulfate (AES) with the following formula (I):

$$R—O—(C_2H_4O)_x—SO_3^-M^+ \quad (I),$$

wherein R is a linear or branched alkyl chain having from 10 to 20 carbon atoms, either saturated or unsaturated; x averages from 1 to 3; and M is selected from the group consisting of alkali metal ions, ammonium, or substituted ammonium. Preferably, R is a linear or branched alkyl chain having from 12 to 16 carbon atoms; x averages 3; and M is sodium. The most preferred anionic surfactant for the practice of the present invention is sodium lauryl ether sulphate with an average degree of ethoxylation of about 3.

The AAS surfactants, if present, can be provided in an amount ranging from about 1% to about 30%, preferably from about 2% to about 20%, more preferably from about 5% to about 15%, by total weight of the non-fibrous laundry detergent sheet.

Nonionic Surfactants

The non-fibrous laundry detergent sheet of the present invention may contain one or more nonionic surfactants, which are to be used in combination with the anionic surfactants described hereinabove. Such nonionic surfactant (s) may be present in an amount ranging from 1% to 40%, preferably from 2% to 30%, more preferably from 5% to 25%, and most preferably from 10% to 20%, by total weight of such non-fibrous laundry detergent sheet.

Suitable nonionic surfactants useful herein can comprise any conventional nonionic surfactant. These can include, for e.g., amine oxide surfactants and alkoxylated fatty alcohols. The nonionic surfactants may be selected from the ethoxylated alcohols and ethoxylated alkyl phenols of the formula $R(OC_2H_4)_nOH$, wherein R is selected from the group consisting of aliphatic hydrocarbon radicals containing from about 8 to about 15 carbon atoms and alkyl phenyl radicals in which the alkyl groups contain from about 8 to about 12 carbon atoms, and the average value of n is from about 5 to about 15. In one example, the nonionic surfactant is selected from ethoxylated alcohols having an average of about 24 carbon atoms in the alcohol and an average degree of ethoxylation of about 9 moles of ethylene oxide per mole of alcohol. Other non-limiting examples of nonionic surfactants useful herein include: $C_8$-$C_{18}$ alkyl ethoxylates, such as, NEODOL® nonionic surfactants from Shell; $C_6$-$C_{12}$ alkyl phenol alkoxylates where the alkoxylate units may be ethyleneoxy units, propyleneoxy units, or a mixture thereof; $C_{12}$-$C_{18}$ alcohol and $C_6$-$C_{12}$ alkyl phenol condensates with ethylene oxide/propylene oxide block polymers such as Pluronic® from BASF; $C_{14}$-$C_{22}$ mid-chain branched alcohols; $C_{14}$-$C_{22}$ mid-chain branched alkyl alkoxylates, wherein x is from 1 to 30; alkylpolysaccharides, and specifically alkylpolyglycosides; polyhydroxy fatty acid amides; and ether capped poly(oxyalkylated) alcohol surfactants. Suitable nonionic surfactants also include those sold under the tradename Lutensol® from BASF.

Preferred nonionic surfactants of the present invention include alkyl polyglucoside, alkyl alcohols, alkyl alkoxylated alcohols, alkyl alkoxylates, alkyl phenol alkoxylates, alkylcelluloses, polyhydroxy fatty acid amides, ether capped poly(oxyalkylated) alcohol surfactants. In a more preferred embodiment, the nonionic surfactant is selected from alkyl alkoxylated alcohols, such as a $C_{8-18}$ alkyl alkoxylated alcohol, and more specifically a $C_{8-18}$ alkyl ethoxylated alcohol. The alkyl alkoxylated alcohol may have an average degree of alkoxylation of from about 1 to about 50, or from about 1 to about 30, or from about 1 to about 20, or from about 1 to about 10. The alkyl alkoxylated alcohol can be linear or branched, substituted or unsubstituted.

In a most preferred embodiment, the non-fibrous laundry detergent sheet of the present invention contains a $C_{12-14}$ alkyl ethoxylated alcohol having an average degree of ethoxylation of from about 1 to about 10, or from about 1 to about 8, or from about 3 to about 7, in an amount ranging from about 1% to about 40%, preferably from about 5% to about 25%, and more preferably from about 10% to about 20%, by total weight of the laundry detergent sheet.

Adjunct Detergent Ingredients

The non-fibrous laundry detergent sheet of the present invention may optionally include one or more other adjunct detergent ingredients for assisting or enhancing cleaning performance or to modify the aesthetics of the sheet. Illustrative examples of such adjunct detergent ingredients include: (1) inorganic and/or organic builders, such as carbonates (including bicarbonates and sesquicarbonates), sulphates, phosphates (exemplified by the tripolyphosphates, pyrophosphates, and glassy polymeric meta-phosphates), phosphonates, phytic acid, silicates, zeolite, citrates, polycarboxylates and salts thereof (such as mellitic acid, succinic acid, oxydisuccinic acid, polymaleic acid, benzene 1,3,5-tricarboxylic acid, carboxymethyloxysuccinic acid, and soluble salts thereof), ether hydroxypolycarboxylates, copolymers of maleic anhydride with ethylene or vinyl methyl ether, 1,3,5-trihydroxy benzene-2,4,6-trisulphonic acid, 3,3-dicarboxy-4-oxa-1,6-hexanedioates, polyacetic acids (such as ethylenediamine tetraacetic acid and nitrilotriacetic acid) and salts thereof, fatty acids (such as $C_{12}$-$C_{18}$ monocarboxylic acids); (2) chelating agents, such as iron and/or manganese-chelating agents selected from the group consisting of amino carboxylates, amino phosphonates, polyfunctionally-substituted aromatic chelating agents and mixtures therein; (3) clay soil removal/anti-redeposition agents, such as water-soluble ethoxylated amines (particularly ethoxylated tetraethylene-pentamine); (4) polymeric dispersing agents, such as polymeric polycarboxylates and polyethylene glycols, acrylic/maleic-based copolymers and water-soluble salts thereof of, hydroxypropylacrylate, maleic/acrylic/vinyl alcohol terpolymers, polyethylene glycol (PEG), polyaspartates and polyglutamates; (5) optical brighteners, which include but are not limited to derivatives of stilbene, pyrazoline, coumarin, carboxylic acid, methinecyanines, dibenzothiphene-5,5-dioxide, azoles, 5- and 6-membered-ring heterocycles, and the like; (6) suds suppressors, such as monocarboxylic fatty acids and soluble salts thereof, high molecular weight hydrocarbons (e.g., paraffins, haloparaffins, fatty acid esters, fatty acid esters of monovalent alcohols, aliphatic $C_{18}$-$C_{40}$ ketones, etc.), N-alkylated amino triazines, propylene oxide, monostearyl phosphates, silicones or derivatives thereof, secondary alcohols (e.g., 2-alkyl alkanols) and mixtures of such alcohols with silicone oils; (7) suds boosters, such as $C_{10}$-$C_{16}$ alkanolamides, $C_{10}$-$C_{14}$ monoethanol and diethanol amides, high sudsing surfactants (e g, amine oxides, betaines and sultaines), and soluble magnesium salts (e.g., $MgCl_2$, $MgSO_4$, and the like); (8) fabric softeners, such as smectite clays, amine softeners and cationic softeners; (9) dye transfer inhibiting agents, such as polyvinyl pyrrolidone polymers, polyamine N-oxide polymers, copolymers of N-vinylpyrrolidone and N-vinylimidazole, manganese phthalocyanine, peroxidases, and mixtures thereof; (10) enzymes, such as proteases, amylases, lipases, cellulases, and peroxidases, and mixtures thereof; (11) enzyme stabilizers, which include water-soluble sources of calcium and/or magnesium ions, boric acid or borates (such as boric oxide, borax and other alkali metal borates); (12) bleaching agents, such as percarbonates (e.g., sodium carbonate peroxyhydrate, sodium pyrophosphate peroxyhydrate, urea peroxyhydrate, and sodium peroxide), persulfates, perborates, magnesium monoperoxyphthalate hexahydrate, the magnesium salt of metachloro perbenzoic acid, 4-nonylamino-4-oxoperoxybutyric acid and diperoxydodecanedioic acid, 6-nonylamino-6-oxoperoxycaproic acid, and photoactivated bleaching agents (e.g., sulfonated zinc and/or aluminum phthalocyanines); (13) bleach activators, such as nonanoyloxybenzene sulfonate (NOBS), tetraacetyl ethylene diamine (TAED), amido-derived bleach activators including (6-octanamidocaproyl)oxybenzenesulfonate, (6-nonanamidocaproyl)oxybenzenesulfonate, (6-decanamidocaproyl)oxybenzenesulfonate, and mixtures thereof, benzoxazin-type activators, acyl lactam activators (especially acyl caprolactams and acyl valerolactams); and (14) any other known detergent adjunct ingredients, including but not limited to carriers, hydrotropes, processing aids, dyes or pigments, and solid fillers.

Film Former

The non-fibrous laundry detergent sheet of the present invention contains, in addition to the surfactant(s) described and adjunct detergent ingredients described hereinabove, at least one film former. Such at least one film former can be selected from water-soluble polymers, either synthetic or natural in origin and may be chemically and/or physically modified.

Suitable examples of water-soluble polymers for the practice of the present invention include polyalkylene glycols (also referred to as polyalkylene oxides or polyoxyalkylenes), polyvinyl alcohols, polysaccharides (such as starch or modified starch, cellulose or modified cellulose, pullulan, xanthum gum, guar gum, and carrageenan), polyacrylates, polymethacrylates, polyacrylamides, polyvinylpyrrolidones, and proteins/polypeptides or hydrolyzed products thereof (such as collagen and gelatin). Preferably, the film former to be used in the present invention is selected from the group consisting of polyalkylene glycols, polyvinyl alcohols, starch or modified starch, cellulose or modified cellulose, polyacrylates, polymethacrylates, polyacrylamides, polyvinylpyrrolidones, and combinations thereof. In a particularly preferred embodiment of the present invention, the non-fibrous laundry detergent sheet contains a polyethylene glycol (PEG) or a polyvinyl alcohol (PVA), either alone (i.e., without other film formers) or in combination with a polystarch, modified starch, cellulose, or modified cellulose.

In the execution of PEG, the PEG may be selected from poly(ethylene glycol) homopolymers and poly(ethylene glycol) copolymers having a weight average molecular weight of between about 2,000 and about 100,000 g/mol, preferably between about 4,000 and about 90,000 g/mol, and more preferably between about 6,000 and about 8,000 g/mol. Suitable poly(ethylene glycol) copolymers preferably contain at least about 50 wt % of PEG and may be selected from the group consisting of poly(lactide-block-ethylene glycol), poly(glycolide-block-ethylene glycol), poly(lactide-co-caprolactone)-block-poly(ethylene glycol), poly(ethylene glycol-co-lactic acid), poly(ethylene glycol-co-glycolic acid), poly(ethylene glycol-co-poly(lactic acid-co-glycolic acid), poly(ethylene glycol-co-propylene glycol), poly(ethylene oxide-block-propylene oxide-block-ethylene oxide), poly(propylene oxide-block-ethylene glycol-block-propylene glycol), and poly(ethylene glycol-co-caprolactone). Exemplary poly(ethylene glycol) homopolymers are commercially available from Sigma Aldrich, or from Dow under the tradename of CARBOWAX™, or from BASF under the tradename of Pluriol®. Exemplary poly(ethylene glycol) copolymers are commercially available from BASF under the tradenames of Pluronic® F127, Pluronic® F108, Pluronic® F68 and Pluronic® P105. A particularly preferred PEG for the practice of the present invention is a poly (ethylene glycol) homopolymer having a weight average molecular weight of between about 6,000 and about 80,000 g/mol.

In the execution of PVA, the PVA may be unmodified or modified, e.g., carboxylated or sulfonated. Preferably, the PVA is partially or fully alcoholised or hydrolysed. For example it may be from 40 to 100%, preferably 70 to 92%, more preferably 88% to 92%, alcoholised or hydrolysed. The degree of hydrolysis is known to influence the temperature at which the PVA starts to dissolve in water, e.g., 88% hydrolysis corresponds to a PVA film soluble in cold (i.e. room temperature) water, whereas 92% hydrolysis corresponds to a PVA film soluble in warm water. An example of preferred PVA is ethyoxylated PVA. A more preferred example of PVA is commercially available from Sekisui Specialty Chemicals America, LLC (Dallas, Tex.) under the tradename CELVOL®. Another more preferred example of PVA is the so-called G Polymer commercially available Nippon Ghosei.

The film former may be present in the non-fibrous laundry detergent sheet of the present invention at from about 1% to about 70%, preferably from about 2% to about 60%, more preferably from about 5% to about 50%, and most preferably from about 10% to about 40%, by total weight of the sheet.

In addition to the film former, the non-fibrous laundry detergent sheet may also comprise suitable additives such as plasticizers and solids, for modifying the properties of the film former. Suitable plasticizers are, for example, pentaerythritols such as depentaerythritol, sorbitol, mannitol, glycerine and glycols such as glycerol or ethylene glycol. Plasticizers are generally used in an amount of up to 35 wt %, for example from 5 to 35 wt %, preferably from 7 to 20 wt %, more preferably from 10 to 15 wt %. Solids such as talc, stearic acid, magnesium stearate, silicon dioxide, zinc stearate or colloidal silica may also be used, generally in an amount ranging from about 0.5 to 5 wt %.

Process of Making

The non-fibrous laundry detergent sheet can be made by any suitable film-forming method, such as casting, molding, pressing, extrusion/extrusion-coating, calendar rolling, solution deposition, skiving, and lamination. For example, it can be formed by first providing a slurry containing raw materials dissolved or dispersed in water, and then shaping the slurry into a sheet-like form. Drying is carried out either simultaneously with the shaping step, or it can be carried out subsequently, to remove water and form a finished sheet with little or no moisture content (e.g., less than 3 wt % water).

A preferred but non-limiting process for making the non-fibrous laundry detergent sheet of the present invention by using a cylinder sheet production system is described hereinafter.

The cylinder sheet production system comprises a base bracket with a heated rotatable cylinder installed thereon. The heated rotatable cylinder can be driven by a motorized drive installed on the base bracket, and work at a predetermined rotation speed. Said heated rotatable cylinder is preferably coated with a non-stick coating on its outer surface.

There is also provided a feeding mechanism on the base bracket, which is for adding a pre-formed slurry containing all or some raw materials described hereinabove (e.g., the surfactant(s), the film former(s), and adjunct detergent ingredients) onto the heated rotatable cylinder. The feeding mechanism includes a feeding rack installed on the base bracket, while said feeding rack has installed thereupon at least one (preferably two) feeding hopper(s), an imaging device for dynamic observation of the feeding, and an adjustment device for adjusting the position and inclination angle of the feeding hopper.

There is also a heating shield installed on the base bracket, to prevent rapid heat lost. Otherwise, the slurry can solidify too quickly on the heated rotatable cylinder. The heating shield can also effectively save energy needed by the heated rotatable cylinder, thereby achieving reduced energy consumption and provide cost savings. The heating shield is a modular assembly structure, or integrated structure, and can be freely detached from the base bracket. A suction device is also installed on the heating shield for sucking the hot steam, to avoid any water condensate falling on the laundry detergent sheet that is being formed. There is also a start feeding mechanism installed on the base bracket, which is for scooping up the laundry detergent sheet already formed by the heated rotatable cylinder.

The making process of the non-fibrous laundry detergent sheet is as follows. Firstly, the heated rotatable cylinder with the non-stick coating on the base bracket is driven by the motorized drive. Next, the adjustment device adjusts the feeding mechanism so that the distance between the feeding hopper and the outer surface of the heated rotatable cylinder reaches a preset value. Meanwhile, the feeding hopper adds the pre-formed slurry containing all or some raw materials for making the non-fibrous laundry detergent sheet onto the heated rotatable cylinder. The suction device of the heating shield sucks the hot steam generated by the heated rotatable cylinder.

Next, the start feeding mechanism scoops up the dried laundry detergent sheet. The already formed laundry detergent sheet can then be sliced or cut into desired sizes by a slicing/cutting device downstream of the heated rotatable cylinder. Optionally, it is further embossed with lines, patterns, logos, etc. by an embossing device downstream of the heated rotatable cylinder.

As noted above, the lines of frangibility can be introduced to the laundry detergent sheet in a variety of ways. For example, a line of pins having a certain diameter, and spaced equidistantly apart from one another, may be pressed partially or entirely through the thickness of such detergent sheet to generate multiple indentations or perforations that form the desired line of frangibility. Lines of frangibility may be imparted to the laundry detergent sheet by other means, e.g., chemical or mechanical etching, so long as they result in a line of weakness along which a user of the sheet may readily separate the sheet into smaller sections.

The laundry detergent sheet may be packaged in a waterproof container, either rigid or flexible, to protect it from water or ambient moisture that may comprise its integrity over time. In some embodiments of the present invention, such container will contain not only the laundry detergent sheet(s) of the present invention, but also other detersive products.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A non-fibrous laundry detergent sheet comprising a perimeter, the non-fibrous laundry detergent sheet further comprising at least one surfactant and at least one film former, wherein the laundry detergent sheet is completely or substantially water-soluble, wherein the laundry detergent sheet has a thickness ranging from 0.1 mm to 10 mm, a length to thickness aspect ratio of at least 5:1, and a width-to-thickness aspect ratio of at least 5:1, wherein the laundry detergent sheet comprises at least a first section and a second section separated by at least one line of frangibility, wherein the first section and the second section have different sizes, wherein the at least one line of frangibility has a first end and a second end, and wherein the at least one line of frangibility contacts the perimeter on at least one of the first end or the second end.

2. The non-fibrous laundry detergent sheet according to claim 1, wherein the laundry detergent sheet further comprises a third section separated from the first and second sections by addition line(s) of frangibility, wherein the third section has a different size from both the first section and the second section.

3. The non-fibrous laundry detergent sheet according to claim 1, wherein the laundry detergent sheet further comprises a third section separated from the first and second sections by additional line(s) of frangibility, wherein the third section has a size, wherein the size of the third section is the same size as either the first section or the second section.

4. The non-fibrous laundry detergent sheet according to claim 1, wherein the first and second sections are marked by different size indicators, different artworks, or different colors, wherein said different size indicators designate different laundry detergent doses.

5. The non-fibrous laundry detergent sheet according to claim 1, wherein the first and second sections contain different surfactants and/or different adjunct detergent ingredients.

6. The non-fibrous laundry detergent sheet according to claim 1, wherein said line(s) of frangibility are formed by indentation or perforation.

7. The non-fibrous laundry detergent sheet according to claim 1, wherein the first section has a shape adapted for pre-treating a shirt collar and the second section has a shape adapted for pre-treating a shirt cuff.

8. The non-fibrous laundry detergent sheet according to claim 1, wherein either the first section or the second section is completely delineated by said line(s) of frangibility.

9. The non-fibrous laundry detergent sheet according to claim 1, wherein the at least one line of frangibility at least partially defines a periphery for each of the first section and the second section, wherein the first section has a periphery comprises at least one protrusion, and the second section has a periphery comprising at least one intrusion, such that the at least one protrusion of the first section and the at least one intrusion of the second section are fitted each other so that the first section and the second section form the laundry detergent sheet like a jigsaw puzzle.

10. The non-fibrous laundry detergent sheet according to claim 1, wherein the laundry detergent sheet is elongated with a longitudinal direction and is wound into a roll along said longitudinal direction.

11. The non-fibrous laundry detergent sheet according to claim 1, wherein said at least one surfactant is present in an amount ranging from 5% to 90% by total weight of such non-fibrous laundry detergent sheet; wherein said at least one surfactant comprises one or more anionic surfactants selected from the group consisting of $C_6$-$C_{20}$ linear alkylbenzene sulfonates (LAS), $C_6$-$C_{20}$ linear or branched alkyl sulfates (AS), $C_6$-$C_{20}$ linear or branched alkylalkoxy sulfates (AAS) having a weight average degree of alkoxylation ranging from 0.1 to 10, and combinations thereof.

12. The non-fibrous laundry detergent sheet according to claim 1, wherein said at least one surfactant comprises: (1) one or more $C_6$-$C_{18}$ linear or branched AS surfactants as a main surfactant(s); and (2) one or more $C_6$-$C_{20}$ LAS and/or $C_6$-$C_{20}$ linear or branched AAS as a co-surfactant(s), wherein said main surfactant(s) are present in an amount that is greater than 50% by total weight of all surfactants in said sheet, and wherein said one or more $C_6$-$C_{18}$ linear or branched AS surfactants are $C_{12}$-$C_{14}$ linear or branched AS surfactants.

13. The non-fibrous laundry detergent sheet according to claim 1, wherein said at least one surfactant comprises: (1) one or more $C_6$-$C_{20}$ LAS surfactants as a main surfactant(s); and (2) one or more $C_6$-$C_{18}$ linear or branched AS and/or $C_6$-$C_{20}$ linear or branched AAS as a co-surfactant(s), wherein said main surfactant(s) are present in an amount that is greater than 50% by total weight of all surfactants in said sheet.

14. The non-fibrous laundry detergent sheet according to claim 1, wherein said at least one film former is present in an amount ranging from 1% to 70% by total weight of such non-fibrous laundry detergent sheet; wherein said at least one film former comprises one or more water-soluble polymers; wherein said one or more water-soluble polymers are selected from the group consisting of polyalkylene glycols, polyvinyl alcohols, starch or modified starch, cellulose or modified cellulose, polyacrylates, polymethacrylates, polyacrylamides, polyvinylpyrrolidones, and combinations thereof.

15. A non-fibrous laundry detergent sheet, comprising at least one surfactant and at least one film former, wherein the laundry detergent sheet is completely or substantially water-soluble, and has a thickness ranging from 0.1 mm to 10 mm; wherein the laundry detergent sheet is elongated with a longitudinal direction and is wound into a roll along said longitudinal direction; wherein the laundry detergent sheet comprises a line of frangibility so that the laundry detergent sheet can be separated into two or more sub-sheets by said line of frangibility.

* * * * *